US008430701B2

(12) United States Patent
Jegel et al.

(10) Patent No.: US 8,430,701 B2
(45) Date of Patent: Apr. 30, 2013

(54) DRIVE DEVICE FOR A WATERCRAFT

(75) Inventors: Franz P. Jegel, Steyr (AT); Johannes Bernögger, Molln (AT); Thomas Lang, Steyr (AT)

(73) Assignee: Franz Peter Jegel, Steyr (AT)

( * ) Notice: Subject to any disclaimer, the term of this patent is extended or adjusted under 35 U.S.C. 154(b) by 501 days.

(21) Appl. No.: 12/227,857

(22) PCT Filed: May 24, 2007

(86) PCT No.: PCT/AT2007/000246

§ 371 (c)(1),
(2), (4) Date: Jul. 16, 2010

(87) PCT Pub. No.: WO2007/137312

PCT Pub. Date: Dec. 6, 2007

(65) Prior Publication Data

US 2010/0323565 A1 Dec. 23, 2010

(30) Foreign Application Priority Data

Jun. 1, 2006 (AT) ..... A 949/2006

(51) Int. Cl.
*B63H 20/08* (2006.01)

(52) U.S. Cl.
USPC ..... 440/53

(58) Field of Classification Search ..... 440/49, 440/51, 53, 57, 58, 59, 61 S, 61 T, 75, 76, 440/78; 74/325–379
See application file for complete search history.

(56) References Cited

U.S. PATENT DOCUMENTS

| | | | |
|---|---|---|---|
| 1,801,612 | A | 4/1931 | Pierce |
| 1,980,685 | A | 11/1934 | Johnson |
| 2,335,597 | A | 11/1943 | Mathewson |
| 3,396,692 | A | 8/1968 | Bergstedt |
| 3,589,204 | A | 6/1971 | Langley |

(Continued)

FOREIGN PATENT DOCUMENTS

| | | |
|---|---|---|
| DE | 3519599 | 1/1986 |
| DE | 0058151 | 10/2000 |
| WO | 2005007503 | 1/2005 |

OTHER PUBLICATIONS

English Abstract of DE3519599, Oct. 27, 2010.

*Primary Examiner* — Lars A Olson
*Assistant Examiner* — Anthony Wiest
(74) *Attorney, Agent, or Firm* — Dykema Gossett PLLC

(57) ABSTRACT

The invention relates to a drive device (1) for a watercraft (2) comprising a U or Z-shaped drive train. The drive torque is preferably deflected in the operating position at least twice about the angle (b, g)>0 via at least two bevel gears (23, 24, 20) between a motor shaft of a drive machine formed, preferably, by an internal combustion engine and at least one propeller shaft (13*a*, 13*b*). In order to control said drive device in a simple manner and to obtain achieve high shifting convenience, the housing (G) of the drive device (1) consists of one first, one second and one third housing part (4, 5, 6). The three housing parts (4, 5, 6) are rotationally connected to one another and the first housing part (4) can be securely connected to the pre-fabricated wall (2*a*) of the watercraft (2). The second housing part (5) is pivotably connected to the first housing part (4) about a first rotational axis (14*a*) and the third housing part (6) is rotationally connected to the second housing part (5) about a second rotational axis (14*b*).

15 Claims, 4 Drawing Sheets

U.S. PATENT DOCUMENTS 3,797,448 A 3/1974 Cramer
4,878,864 A * 11/1989 Van Bentem ..... 440/5
4,948,384 A 8/1990 Bland et al.
5,383,375 A * 1/1995 Ogawa et al. ..... 74/330
6,435,923 B1 * 8/2002 Ferguson ..... 440/75
6,899,577 B2 5/2005 Yasuda et al.
6,971,932 B2 * 12/2005 Maselter ..... 440/83
7,104,853 B1 * 9/2006 Kepka ..... 440/57

* cited by examiner

Fig. 1
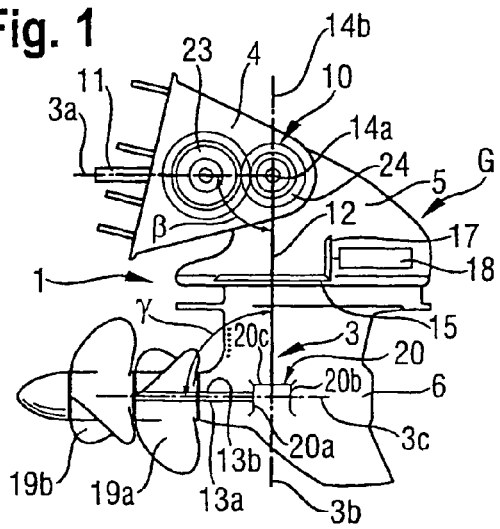
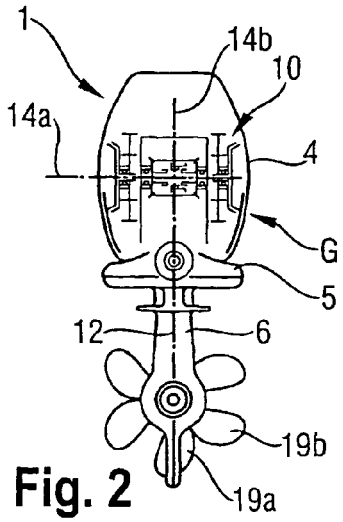
Fig. 2
Fig. 3
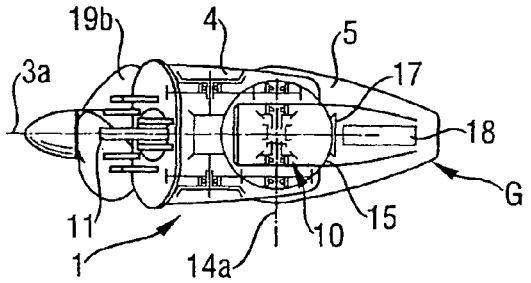
Fig. 4
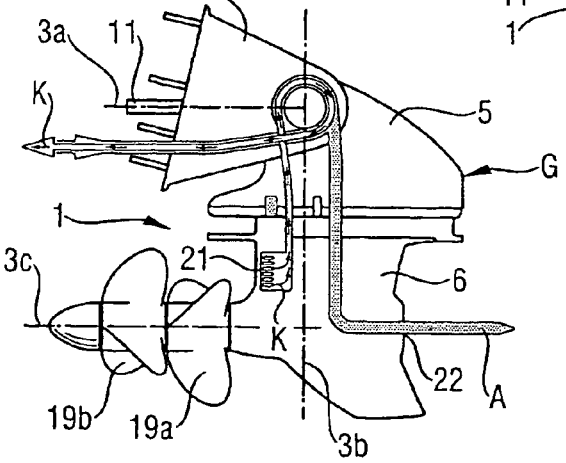
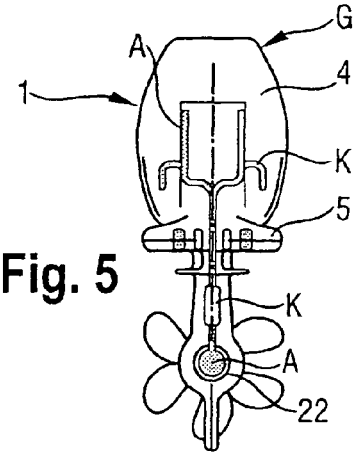
Fig. 5
Fig. 6
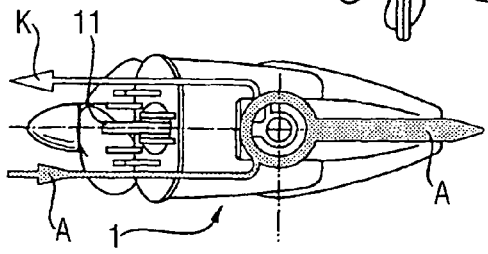

Fig. 7
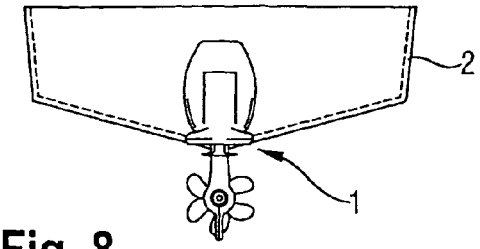
Fig. 8
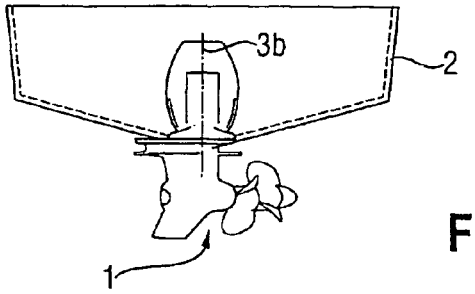
Fig. 9
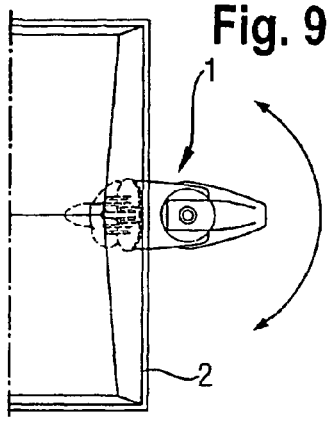
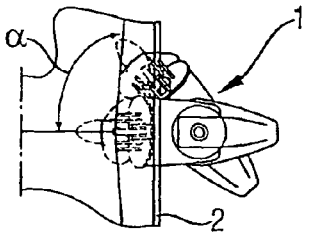
Fig. 10
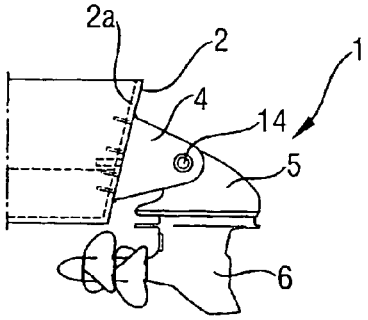
Fig. 11
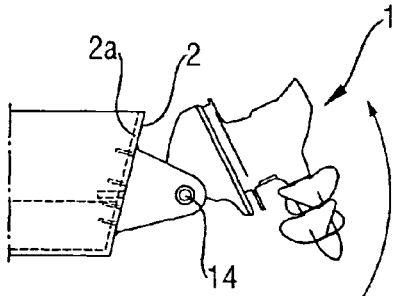
Fig. 13
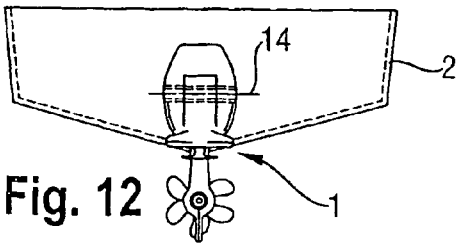
Fig. 12
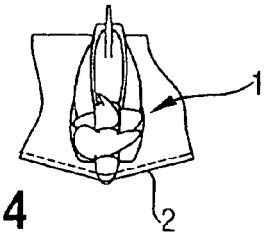
Fig. 14

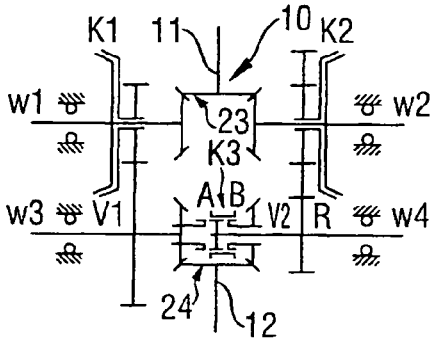
Fig. 15
| | K1 | K2 | A | B |
|---|---|---|---|---|
| L | | | | |
| V1 | × | | | × |
| V2 | | × | | × |
| R | | × | × | |
Fig. 16
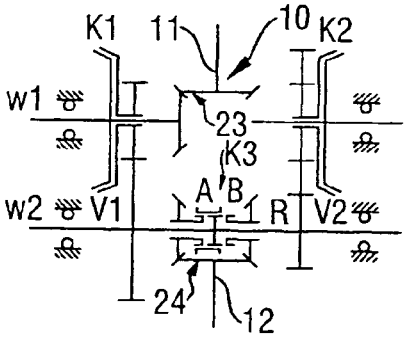
Fig. 17
| | K1 | K2 | A | B |
|---|---|---|---|---|
| L | | | | |
| V1 | × | | × | |
| V2 | | × | × | |
| R | × | | | × |
Fig. 18
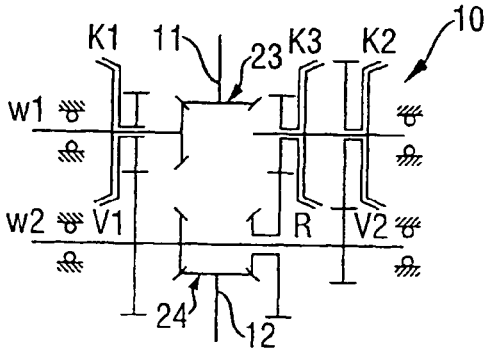
Fig. 19
| | K1 | K2 | K3 | |
|---|---|---|---|---|
| L | | | | |
| V1 | × | | | |
| V2 | | × | | |
| R | | | × | |
Fig. 20

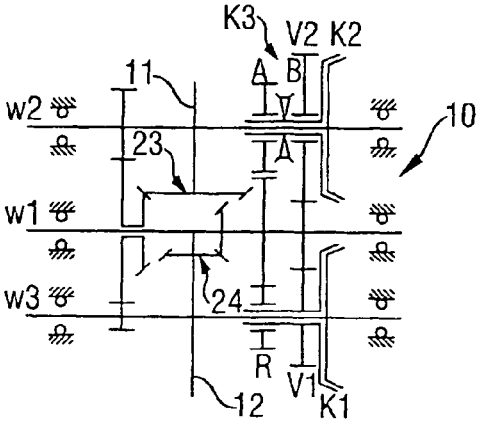
Fig. 21
| | K1 | K2 | A | B |
|---|---|---|---|---|
| L | | | | |
| V1 | × | | | |
| V2 | | × | | × |
| R | | × | × | |
Fig. 22
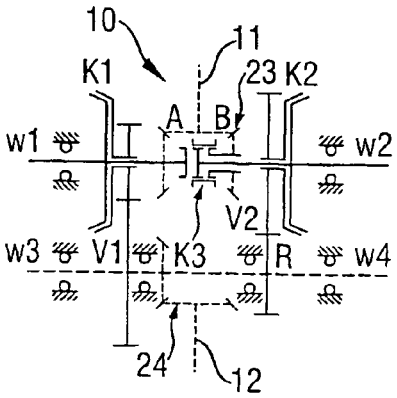
Fig. 23
| | K1 | K2 | A | B |
|---|---|---|---|---|
| L | | | × | |
| V1 | × | | × | |
| V2 | | × | × | |
| R | | × | | × |
Fig. 24

DRIVE DEVICE FOR A WATERCRAFT

The invention relates to a drive assembly for a watercraft with a U-shaped or Z-shaped drive train, in which the driving torque is redirected at least twice through an angle >0 preferably via at least two bevel gears between the engine shaft of the driving engine, preferably an internal combustion engine, and at least one propeller shaft in operational position, where the housing of the drive assembly comprises a first, a second and a third housing part, the three housing parts being rotatably connected, and where the first housing part may be rigidly attached to a mounting panel of the water craft, while the second housing part is connected to the first housing part in such a way that it can be tilted about a first rotation axis and the third housing part is connected to the second housing part in such a way that it can be rotated about a second rotation axis.

There are known outboard propulsion units for boats, where the entire engine attached to a mounting panel is rotated to steer the boat. The steering motion can be transmitted to the outboard motor by means of levers or cables. It is also known to use electrical motors for transmitting the steering motion to the outboard motor via levers or cables.

From U.S. Pat. No. 3,797,448 there is known an electrical trolling motor for driving small boats. The motor driving the propeller acts on a drive train via electrical clutches. By means of an additional steering gear the trolling motor may be rotated relative to a support tube which is fixed in the boat. Motor housing and steering gear are positioned below the water line. It is a disadvantage that the whole motor housing plus electrical motor and gearbox must be rotated to steer the boat, which on account of mass inertia is feasible only for low-power, low-weight drive units.

DE 2 043 781 A1 describes the drive assembly of a watercraft where the motor is located inside the boat. The drive assembly comprises three housing parts which can be rotated against one another. There is no provision for gear shifting.

From U.S. Pat. No. 2,335,597 a drive assembly for a propeller is known which comprises a plurality of housing parts. The drive assembly, which can be rotated about both a horizontal and a vertical axis, is powered by a motor located inside the boat, redirection being achieved by a bevel gear. There is no provision for gear shifting.

U.S. Pat. No. 3,396,692 A also discloses a propeller drive assembly, which may be tilted up and rotated for steering. The drive is powered via a belt by a motor located inside the boat, with a reverse gear but no shifting gear being provided in the drive train.

Furthermore there is known from U.S. Pat. No. 1,980,685 A a drive assembly for a propeller with a plurality of housing parts. This drive assembly may also be tilted up and rotated for steering, and is driven via bevel gears by a motor located inside the boat. Here too there is no provision for gear shifting.

WO 2005/007503 A1 describes a two-stage drive assembly for watercraft, where an input shaft is connected via a first clutch to a coaxial output shaft. By means of a second clutch the input shaft may furthermore be connected to the output shaft via a gearbox, the drive trains via the first and the second clutch having different transmission ratios.

U.S. Pat. No. 6,899,577 B2 describes an outboard motor which can be put in forward or in reverse gear, where two electromagnetic clutches are provided for optionally connecting either the forward drive step or the reverse drive step to the propeller shaft.

From DE 35 19 599 A1 there is known a drive assembly for boats, which is configured as a socalled U-drive train, where two forward propelling screws driven in opposite directions are provided at the front of the lower housing part of the drive assembly in order to increase screw efficiency and propelling force. A similar drive assembly is known from WO 00/58151.

It is the object of the present invention to propose a drive assembly which permits easy steering also for high-power engines. A further aim is increased ease of handling in reversing and gear-shifting.

The invention achieves these objects by providing that a gearbox is contained in the first housing part, whose output shaft is coaxial with the second rotation axis, the propeller shaft being preferably borne in the third housing part. By positioning the gearbox in the first housing part, and connecting its output shaft, preferably by bevel gears, via a connecting shaft coaxial with the second roation axis, the masses involved in steering motion can be kept to a minimum.

Since the drive for the rotating motion is placed in the second housing part and the gearbox is placed in the first housing part, which is rigidly attached to the watercraft, only relatively small masses—i.e. the third housing part with the propeller shaft—have to be moved in steering the boat, which will permit fast steering motion and good maneuverability. Propulsion via the connecting shaft will also permit large steering amplitudes (360°, i.e. unlimited), further enhancing the maneuverability of the boat.

Steering the drive assembly can be effected in a particularly simple manner if the third housing part has a crown gear or bevel gear coaxial with the second rotation axis, which meshes with a drive gear, said drive gear preferably being driven by an electrical servomotor located in the second housing part. To steer the watercraft only the third part situated below the water line is rotated.

In order to avoid exposed pipes, it is of special advantage if the third housing part has at least one cooling water inlet opening, which is connected to the drive motor via a coolant flow path within the second and first housing part, and if preferably the third housing part has at least one exhaust gas outlet opening, which is connected to the drive motor via an exhaust gas flow path provided in the third, second and first housing part. Thus there are no coolant or exhaust pipes to be seen outside the housing.

In a further embodiment of the invention it is proposed that for each forward gear step a switchable clutch is provided, where by activating the first clutch the input shaft is connected via the first forward gear step to the output shaft and by activating the second clutch is connected via the second forward gear step to the output shaft, and where in the idling state first and second clutch are deactivated and the input shaft is disconnected from the output shaft, and that shifting into reverse gear may be carried out by switching a third clutch preferably from a forward position to a reverse position. In a preferred embodiment it may be provided that the third clutch is configured as a switchover clutch, with the input shaft in a forward switch position being connected to the output shaft via the first or second forward gear step and in a reverse switch position via a reverse gear step, the third clutch preferably being configured as a synchronizing device.

The third clutch may be positioned in the drive train between input shaft and output shaft in series with the first and/or second forward gear step. Alternatively it is also possible to position the third clutch in the drive train between input shaft and output shaft in parallel with the first and/or second forward gear step.

The clutches may be realized for instance as cone friction clutches.

Rapid and automated shifting of gears will be possible if the first, second and/or third clutch can be actuated electrically. Alternatively, gear shifting may be supported hydraulically.

By letting at least two clutches slip it will be possible to change the forward gear steps and preferably also the reverse gear step under load.

The invention will now be described in more detail with reference to the enclosed drawings. There is shown in FIG. 1 a side view of a drive assembly according to the invention;

FIG. 2 the drive assembly in a rear view;

FIG. 3 the drive assembly in a view from above;

FIG. 4 the drive assembly in a side view, with schematically indicated coolant and exhaust gas flow paths;

FIG. 5 the drive assembly of FIG. 4 in a rear view;

FIG. 6 the drive assembly in a view from above;

FIG. 7 a boat with a drive assembly according to the invention in a sectional rear view;

FIG. 8 the boat of FIG. 7 in sectional rear view with rotated drive assembly;

FIG. 9 the boat in plan view;

FIG. 10 the boat in plan view with rotated drive assembly;

FIG. 11 a side view of the boat with mounted drive assembly;

FIG. 12 the boat in rear view;

FIG. 13 the boat in a side view, with the drive assembly tilted upwards;

FIG. 14 the boat with the drive assembly tilted upwards, in a rear view;

FIG. 15 a gearbox of the drive assembly according to the invention in a first embodiment;

FIG. 16 a clutch activation pattern for this gearbox;

FIG. 17 a gearbox of the drive assembly according to the invention in a second embodiment;

FIG. 18 a clutch activation pattern for this gearbox;

FIG. 19 a gearbox of the drive assembly according to the invention in a third embodiment;

FIG. 20 a clutch activation pattern for this gearbox;

FIG. 21 a gearbox of the drive assembly according to the invention in a fourth embodiment;

FIG. 22 a clutch activation pattern for this gearbox;

FIG. 23 a gearbox of the drive assembly according to the invention in a fifth embodiment; and FIG. 24 a clutch activation pattern for this gearbox.

The drive assembly 1 for a watercraft 2, for instance a boat, has a U-shaped drive train 3 in the embodiments shown, the main axes of the drive train being indicated by 3*a*, 3*b*, 3*c*. In operational position, i.e. in normal cruising position, at least two of the main axes 3*a*, 3*b*, 3*c* form an angle β, γ greater 0°. The housing G of the drive assembly 1 comprises three housing parts 4, 5, 6. In the first housing part 4 a gearbox 10 is located, which is connected via an input shaft 11 to a drive motor, for instance an internal combustion engine not shown here, and via an output shaft 12 to at least one propeller shaft 13*a*, 13*b*. The first housing part 4 can be attached to a mounting panel 2*a* of the boat and is then rigidly attached to the boat. A second housing part 5, which can rotate about a rotation axis 14*a*, is connected to the first housing part 4. The second housing part 5 is connected to a third housing part 6, which third housing part 6 can rotate relative to the second housing part 5 about a second rotation axis 14*b*, which during operation runs in vertical direction. The second rotation axis 14*b* coincides with the main axis 3*b* of the drive assembly 3. The third housing part 6 has a crown gear 15 meshing with a drive gear 17, which is driven for instance by an electrical servomotor 18. Servomotor 18 and drive gear 17 are located within the second housing part 5.

The propeller shaft 13*a*, 13*b* is borne in the third housing part 6. In the embodiment shown the first propeller shaft 13*a* is a hollow shaft and the second propeller shaft 13*b* is an interior shaft guided in the hollow shaft. Two propellers 19*a*, 19*b* are driven in opposite directions by the two propeller shafts 13*a* and 13*b*. The two propeller shafts 13*a*, 13*b* are driven from the output shaft 12 of the gearbox 10 via a bevel gearbox 20 with bevel gears 20*a*, 20*b*, 20*c*.

The third housing part 6 has on the bow side at least one inlet opening 21 for cooling water, through which cooling water is sucked in and fed to the drive motor as indicated by arrows K in FIGS. 4 to 6. On the stern side the third housing part has at least one outlet opening 22, through which the exhaust gases are vented via exhaust gas lines connected to the drive motor, as indicated by arrows A in FIGS. 4 to 6. The pipes carrying cooling water K and exhaust gases A are located entirely within the housing parts 4, 5, 6, and thus exposed pipes are avoided.

FIGS. 7 to 10 show the steering motion of the third housing part 6 as the crown gear 15 is turned by the servomotor 18. Since only the third housing part 6 is rotated, large steering amplitudes a (360°, i.e. unlimited) can be realized.

Due to the fact that the gearbox 10 is located in the first housing part 4, which is rigidly mounted in the watercraft 2, the other two housing parts 5, 6 may be lifted out of the water relatively easily by tilting them about the horizontal axis 14, as is indicated in FIGS. 11 to 14.

The gearbox 10 is configured as a bevel gearbox with at least two switching clutches K1, K2 for at least two forward gear steps V1, V2 and one reverse gear step R. FIG. 15 shows a first variant of the gearbox 10 with two switchable clutches K1, K2, both of which may be realized as electrically actuated cone friction clutches. Force transmission to the output shaft 12 is effected via shafts w1, w2 by means of a first bevel gear 23 and two forward gear steps V1, V2 with different transmission ratios and a second bevel gear 24. Intermediate shafts are designated w3 and w4. In the idling state the two clutches K1, K2 are deactivated and the input shaft 11 is separated from the output shaft 12. Activation of the first clutch K1 connects the input shaft 11 via the first forward gear step V1 to the output shaft 12, while activation of the second clutch K2 connects the input shaft 11 via the second forward gear step V2 to the output shaft 12.

Due to the special arrangement of the gearbox 10 with the bevel gears 23, 24 a simple and effective lifting motion of the housing G about the rotation axis 14*a* will be obtained. This will furthermore permit a very large lifting and tilting range. An optimum trailer-up-position of the housing is ensured. Steering and lifting motions are independent of each other, and thus the mechanisms for the motions can be realized relatively simply.

In contrast to drive assemblies using universal joints the flow of force via the bevel gears will not be blocked when the housing G is tilted up—for instance due to a collision with an obstacle. On contact with an obstacle the drive assembly 1 will simply tilt away.

The large tilting range permits easy access to the propellers 19*a*, 19*b* and the inlet opening 21 for the cooling water for cleaning and maintenance purposes. For maintenance reasons the boat need not be brought out of the water and no diving gear will be required in the case of repair works.

A clutch activation pattern for the gearbox 10 of FIG. 15 is presented in FIG. 16.

In the idling state L both clutches K1, K2 are open. A third clutch K3 realized by a synchronizing mechanism is in position "B" as shown in FIG. 15.

When shifting from idling state L to the first forward gear step V1 the first clutch K1 is activated. The third clutch K3 remains in position "B". When shifting from the first forward gear step V1 to the second forward gear step V2 the first clutch K1 is disengaged and the second clutch K2 is engaged with slip, a gentle transition being desired. In the second forward gear step V2 the second clutch K2 is engaged and the third clutch K3 is still in position "B". Shifting into reverse gear R is carried out by disengaging clutch K2 if it is activated, and activating clutch K1. After clutch K1 is engaged the third clutch K3 is switched to position "A". Thereby the direction of rotation of shaft w4 is reversed. Now the first clutch K1 is again disengaged and the second clutch K2 is engaged. This will again reverse the direction of rotation of shaft w4. These steps will have a braking effect on the output shaft 12 and will thus avoid damage due to abrupt change of direction. In the reverse gear step R the first clutch K1 is disengaged, the second clutch K2 is engaged, while the third clutch K3 is in position "A".

FIG. 17 shows a gearbox 10 with two intermediate shafts w1, w2, two switchable clutches K1, K2 realized as cone friction clutches, and a third clutch K3 realized by a synchronizing mechanism, a coupling sleeve or dog, which can be switched between two positions "A" and "B". The switching processes are schematically described as shown in the table of FIG. 18. In the idling state L the first and second clutch K1, K2 are disengaged, the third clutch K3 is in position "A". Shifting to the first forward gear step V1 is done by engaging the first clutch K1, the third clutch K3 remaining in position "A". Shifting to the second forward gear step V2 is done by disengaging the first clutch K1 and engaging the second clutch K2, a gentle transition being desirable. The third clutch K3 is still in position "A". To shift into reverse R, the second clutch K2 (or first clutch K1) is disengaged, the third clutch K3 is switched to position "B". Therafter the first clutch K1 is again engaged.

FIG. 19 shows a third embodiment of the gearbox 10 in a two-shaft design, where three clutches K1, K2, K3 realized as cone friction clutches are provided. In the idling state clutches K1, K2, K3 are disengaged. To shift to the first forward gear step V1 the first clutch K1 is engaged. Shifting to the second forward gear step V2 is done by disengaging clutch K1 and engaging clutch K2 with gentle transition. Shifting into reverse R is done by disengaging the first or second clutch K1, K2 and engaging the third clutch K3.

FIG. 21 shows a fourth embodiment of the gearbox 10 with three intermediate shafts w1, w2, w3, two clutches K1, K2 realized as cone friction clutches, and a third clutch K3 realized by a synchronizing mechanism. In the idling state L the first clutch K1 and the second clutch K2 are disengaged, clutch K3 is in a neutral position. Shifting to the first forward gear step V1 is done by engaging the first clutch K1. Shifting into the second forward gear step V2 is initiated by switching clutch K3 to position "B". While the first clutch K1 is disengaged, the second clutch K2 is engaged (gentle transition). Shifting to reverse R is performed by disengaging the second clutch K2 (if it is engaged) and engaging the first clutch K1. The third clutch K3 is switched to position "A", while the first clutch K1 is again disengaged and the second clutch K2 is again engaged (gentle transition). In the reverse gear step R the first clutch K1 is thus disengaged, the second clutch K2 is engaged and the third clutch K3 is in position "A".

FIG. 23 shows a fifth variant of a gearbox 10 with intermediate shafts w1, w2, w3, w4, the intermediate shafts w3, w4 being joined or made as one piece. In the idling state L the first and second clutch K1, K2 are disengaged, the third clutch K3, which is realized by a synchronizing mechanism, is in position "A". When shifting to first forward V1 clutch K1 is engaged, clutch K3 remains in position "A". When shifting into second forward V2 the first clutch K1 is disengaged, while simultaneously the second clutch K2 is engaged, with slip being advantageous for a gentle transition. Clutch K3 remains in position "A". To shift into reverse R, one must first shift down into first forward V1. This is done by disengaging the second clutch K2 and engaging the first clutch K1. The third clutch K3 is switched to position "B"—as shown in FIG. 23. Then the first clutch K1 is again disengaged and simultaneously the second clutch K2 is engaged—with gentle transition. In the reverse gear step R the first clutch K1 is thus disengaged, the second clutch K2 is engaged and the third clutch K3 is in position "B".

The invention claimed is:

1. A drive assembly for a watercraft with a U-shaped or Z-shaped drive train, in which a driving torque is redirected at least twice through an angle >0 between an engine shaft of a driving engine and at least one propeller shaft in operational position, where a housing of a drive assembly comprises a first, second and third housing part, the housing parts being rotatably connected with respect to the other housing parts, and where the first housing part is rigidly attached to a mounting panel of the watercraft, while the second housing part is rotatably connected to the first housing part about a first rotation axis between the first and second housing parts and the third housing part is rotatably connected to the second housing part about a second rotation axis, wherein in the first housing part a shift gearbox is located, wherein an output shaft of the shift gearbox is coaxial with the second rotation axis.

2. The drive assembly according to claim 1, wherein at least one propeller shaft is arranged in the third housing part.

3. The drive assembly according to claim 1, wherein the third housing part has a crown gear or bevel gear coaxial with the second rotation axis, which meshes with a drive gear.

4. The drive assembly according to claim 3, wherein said drive gear is driven by an electrical servomotor located in the second housing part.

5. The drive assembly according to claim 1, wherein the third housing part is provided on the bow side with at least one inlet opening for cooling water, which is connected with the drive engine by means of a coolant flow path extending between the drive engine and the first housing part and being located entirely within the first, second and third housing part.

6. The drive assembly according to claim 1, wherein the third housing part is provided on the stern side with at least one outlet opening for exhaust gas, which is connected with the drive engine by means of an exhaust gas flow path extending between the drive engine and the first housing part and being located entirely within the first, second and third housing part.

7. The drive assembly according to claim 1, wherein the shift gearbox provides at least a first and second forward gear step and a reverse gear step and has an input shaft connected to the engine shaft of the driving engine and an output shaft, and that at least one switchable clutch is provided for each forward gear step, where by activating a first clutch the input shaft is connected to the output shaft via the first forward gear step and by activating a second clutch the input shaft is connected to the output shaft via the second forward gear step, and where in an idling state both first and second clutch are deactivated and the input shaft is separated from the output shaft, and where by switching a third clutch from a forward position to a reverse position the input shaft is connected to the output shaft via the reverse gear step.

8. The drive assembly according to claim 7, wherein the forward gear steps is shifted under load.

9. The drive assembly according to claim 7, wherein the reverse gear step is shifted under load.

10. The drive assembly according to claim 7, wherein the third clutch is configured as a switch-over clutch, where in the forward switch position the input shaft is connected to the output shaft via the first or second forward gear step and in the reverse switch position the input shaft is connected to the output shaft via a reversing gear.

11. The drive assembly according to claim 7, wherein the third clutch is designed as synchronizer unit comprising a synchronizing mechanism and a dog clutch.

12. The drive assembly according to claim 7, wherein the third clutch is positioned in the drive train between the input shaft and the output shaft in series with the first and/or second forward gear step.

13. The drive assembly according to claim 7, wherein the third clutch is positioned in the drive train between the input shaft and the output shaft in parallel with the first and/or second forward gear step.

14. The drive assembly according to claim 7, wherein the first, second and/or third clutch is configured as a cone friction clutch.

15. The drive assembly according to claim 7, wherein the first, second and/or third clutch can be actuated electrically or hydraulically.

* * * * *

UNITED STATES PATENT AND TRADEMARK OFFICE

CERTIFICATE OF CORRECTION

PATENT NO. : 8,430,701 B2
APPLICATION NO. : 12/227857
DATED : April 30, 2013
INVENTOR(S) : Jegel et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1094 days.

Signed and Sealed this
Eighth Day of September, 2015

Michelle K. Lee

Michelle K. Lee
*Director of the United States Patent and Trademark Office*